US008631543B2

(12) United States Patent
Huotari et al.

(10) Patent No.: US 8,631,543 B2
(45) Date of Patent: Jan. 21, 2014

(54) ZIPPER PRE-GATHER DEVICE

(75) Inventors: Keijo J. Huotari, Fenton, MI (US); Eric Hanson, Dearborn, MI (US); Stephen J. Lewis, Harrison Township, MI (US)

(73) Assignee: Magna International Inc., Ontario (CA)

( * ) Notice: Subject to any disclaimer, the term of this patent is extended or adjusted under 35 U.S.C. 154(b) by 642 days.

(21) Appl. No.: 12/925,479

(22) Filed: Oct. 22, 2010

(65) Prior Publication Data

US 2012/0096687 A1 Apr. 26, 2012

(51) Int. Cl.
*A44B 19/26* (2006.01)

(52) U.S. Cl.
USPC ..... 24/426; 24/415

(58) Field of Classification Search
USPC ..... 24/415, 426, 427, 428
See application file for complete search history.

(56) References Cited

U.S. PATENT DOCUMENTS

| | | | | |
|---|---|---|---|---|
| 2,933,792 | A * | 4/1960 | Malmborg | 24/426 |
| 4,819,308 | A * | 4/1989 | Baroky | 24/415 |
| 6,701,584 | B2 * | 3/2004 | Metzger | 24/415 |
| 8,371,003 | B2 * | 2/2013 | Arney et al. | 24/427 |
| 2010/0306971 | A1 * | 12/2010 | Arney et al. | 24/427 |

* cited by examiner

*Primary Examiner* — Robert J Sandy
(74) *Attorney, Agent, or Firm* — Warn Partners, P.C.

(57) ABSTRACT

A zipper pre-gather device which is operable for providing proper alignment of two sides of a zipper tape prior to being fed through a slider, thereby preventing the slider from becoming unintentionally engaged with sections of the foldable, stowable roof or parts of the foldable window. The zipper pre-gather device incudes a slider pivotally attached to a pre-gather device. The pre-gather device has two entrances, one for receiving each side of the zipper tape, which are operable with two exits. The entrances of the pre-gather device are of a large width and height in relation to the exits, and are operable for providing proper alignment between two sides of a zipper tape, prior to the two sides of the zipper tape being fed into the slider.

16 Claims, 2 Drawing Sheets

ZIPPER PRE-GATHER DEVICE

FIELD OF THE INVENTION

The present invention is directed to a zipper type of fastener used for a foldable, stowable roof, for sport utility vehicles. More specifically, the present invention is directed to a pre-gather device which is suited for proper alignment of a two portions of a zipper prior to passing through a zipper slider.

BACKGROUND OF THE INVENTION

Foldable stowable roof tops are commonly used in sport-utility vehicles for recreational purposes. The foldable roof is typically moved between a stowed position, and a deployed position. When in the deployed position, the foldable roof protects the occupants of the vehicle from various weather conditions. The foldable roof also includes various sections which are made of a clear material to essentially function as a window, allowing the occupant of the vehicle to see outside of the vehicle. It is also sometimes desirable to open these clear, foldable, window sections when weather conditions are favorable, but the occupant(s) of the vehicle do not desire to change the foldable roof to the stowed position.

Because these window sections are also foldable, typical window crank devices or electric motors used for opening and closing a window made of glass (which is rigid and not foldable) are not suitable for use with a foldable roof. Therefore, other methods of opening the foldable window have been developed. One of these methods is the use of a zipper, which is typically one continuous zipper that surrounds all sides of the window but one. The one side of the window which is not surrounded by the zipper is the foldable side, allowing the window to be folded from a closed position to an open position. Additionally, zippers may also be used to assemble and disassemble various parts of the roof when roof is being changed between a stowed position and deployed position.

One of the drawbacks to this type of design is that the foldable, stowable roof or the foldable window are not always in proper alignment for the zipper to functions properly. Most zippers are designed for attaching two portions of material along a substantially straight section of each portion of the material, with ideally the two portions of material being approximately twenty degrees apart. Typical zippers consist of a slider portion and two sections of zipper tape, with one section of zipper tape attached to one section of the foldable, stowable roof, and the other section of zipper tape attached to the foldable window or another section of the foldable, stowable roof.

When these types of zippers are used with a foldable window or for connecting two different sections of a foldable, stowable roof, the zipper is often difficult to use. More specifically, if a portion of the foldable, stowable roof or foldable window is folded, crinkled, or has some sort of crease, it is sometimes difficult to provide proper alignment for both sides of the zipper tape prior to entering the slider portion to allow the two sides of the zipper tape to interlock together properly. Various portions of the foldable, stowable roof or the foldable window may be positioned by the operator of the vehicle such that both sides of the zipper tape are in proper alignment. However, this is considered undesirable increased effort in using the zipper. Additionally, some of the material of the foldable, stowable roof may become unintentionally engaged with the slider, making the slider difficult to move and use properly.

Accordingly, there exists a need for a zipper which provides proper alignment between two sides of a zipper tape when connecting a foldable roof and a foldable window having various curved areas

SUMMARY OF THE INVENTION

The present invention is directed to a zipper pre-gather device which is operable for providing proper alignment of two sides of a zipper tape prior to being fed through a slider, thereby preventing the slider from becoming unintentionally engaged with sections of the foldable, stowable roof or parts of the foldable window.

The present invention is a zipper pre-gather device which includes a slider pivotally attached to a pre-gather device. The pre-gather device has two entrances, one for receiving each side of the zipper tape, which are operable with two exits. The entrances of the pre-gather device are of a large width and height in relation to the exits, and are operable for providing proper alignment between two sides of a zipper tape, prior to the two sides of the zipper tape being fed through the slider.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
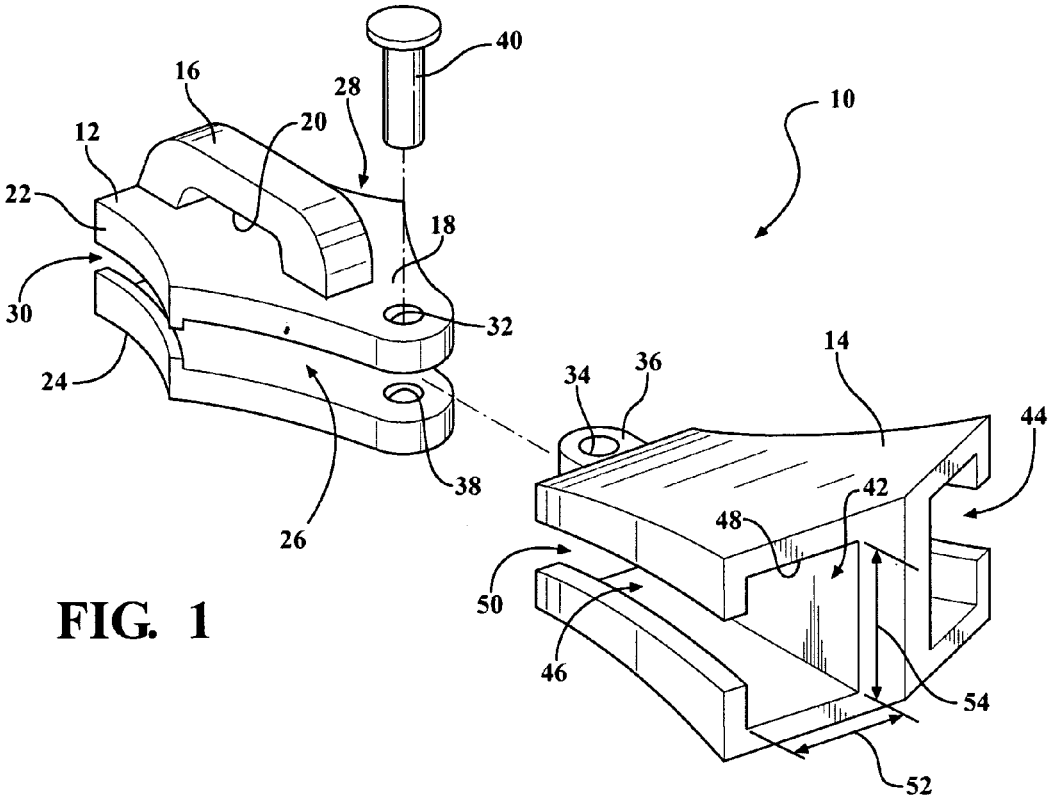
FIG. 1 is an exploded view of a zipper pre-gather device, according to the present invention.
Figure 3:
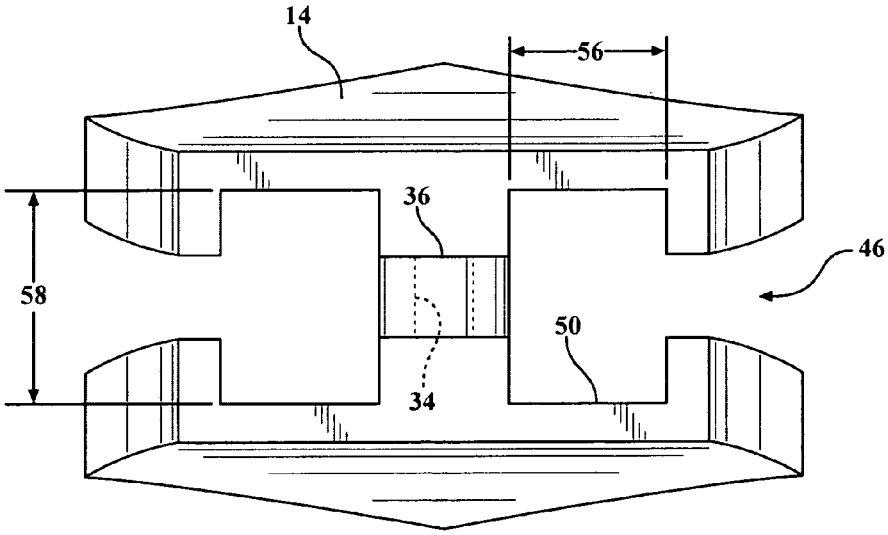
FIG. 3 is a rear view of a pre-gather device which is part of a zipper pre-gather device, according to the present invention.

The following description of the preferred embodiment(s) is merely exemplary in nature and is in no way intended to limit the invention, its application, or uses.

Referring to the Figures generally, a zipper pre-gather device according to the present invention is shown generally at 10. The device 10 includes a first portion, or slider 12, and a second portion, or pre-gather device 14. The slider 12 includes a looped portion 16 which along with a top surface 18 of the slider 12 creates an aperture 20. A handle feature (not shown) is connected to the looped portion 16, and the handle feature is used to move the slider 12 along two sides of a zipper tape.

The top surface 18 is part of an upper section 22, and the upper section 22 is connected to a lower section 24. The slider 12 also includes a first passage, generally shown at 26, and a second passage, generally shown at 28. The first passage 26 and second passage 28 are separate from one another, and each passage 26,28 includes a gapped portion, generally shown at 30, which is used for allowing one side of zipper tape to pass through the slider 12. Each gapped portion 30 extends along a side of the first passage 26 and the second passage 28. One side of the zipper tape passes through the first passage 26 and a second side of the zipper tape passes through the second passage 28. When both sides of the zipper tape are fed through the respective passages 26,28, the two sides of the zipper tape are connected together in a known manner.

The upper section 22 includes a first aperture 32 which is substantially in alignment with a second aperture 34 formed as part of a flange portion 36 connected to the pre-gather device 14. When assembled, the first aperture 32 and second aperture 34 are both in alignment with a third aperture 38 formed as part of the lower section 24. A fastener in the form of a pivot pin 40 is operable for extending through the apertures 32,34,38, thereby providing a pivot relationship between the slider 12 and the pre-gather device 14.

The pre-gather device 14 includes a set of passages, and more particularly, there is a third passage, shown generally at 42 and a fourth passage, shown generally at 44. The third passage 44 and fourth passage 46 are substantially larger than the passages 26,28 formed as part of the slider 12, and allow for the two sides of the zipper tape to be at a large angle relative to one another. Extending along each of the passages 42,44 is a gapped portion, shown generally at 46, which is of substantially the same height as compared to each gapped portion 30 formed as part of each of the passages 26,28. Each of the third and fourth passages 42,44 includes an entrance 48 and an exit 50.

Each entrance 48 is of a width 52 and a height 54. The width 52 of the entrance 48 is larger than the width 56 of the exit 50, and the height 54 of the entrance 48 is larger than the height 58 of the exit 50. This allows for both sides of the zipper tape to be fed through the pre-gather device 14 more easily, thereby reducing the need for manual alignment by the user of both sides of the zipper tape prior to passing through the slider 12.

Figure 2:
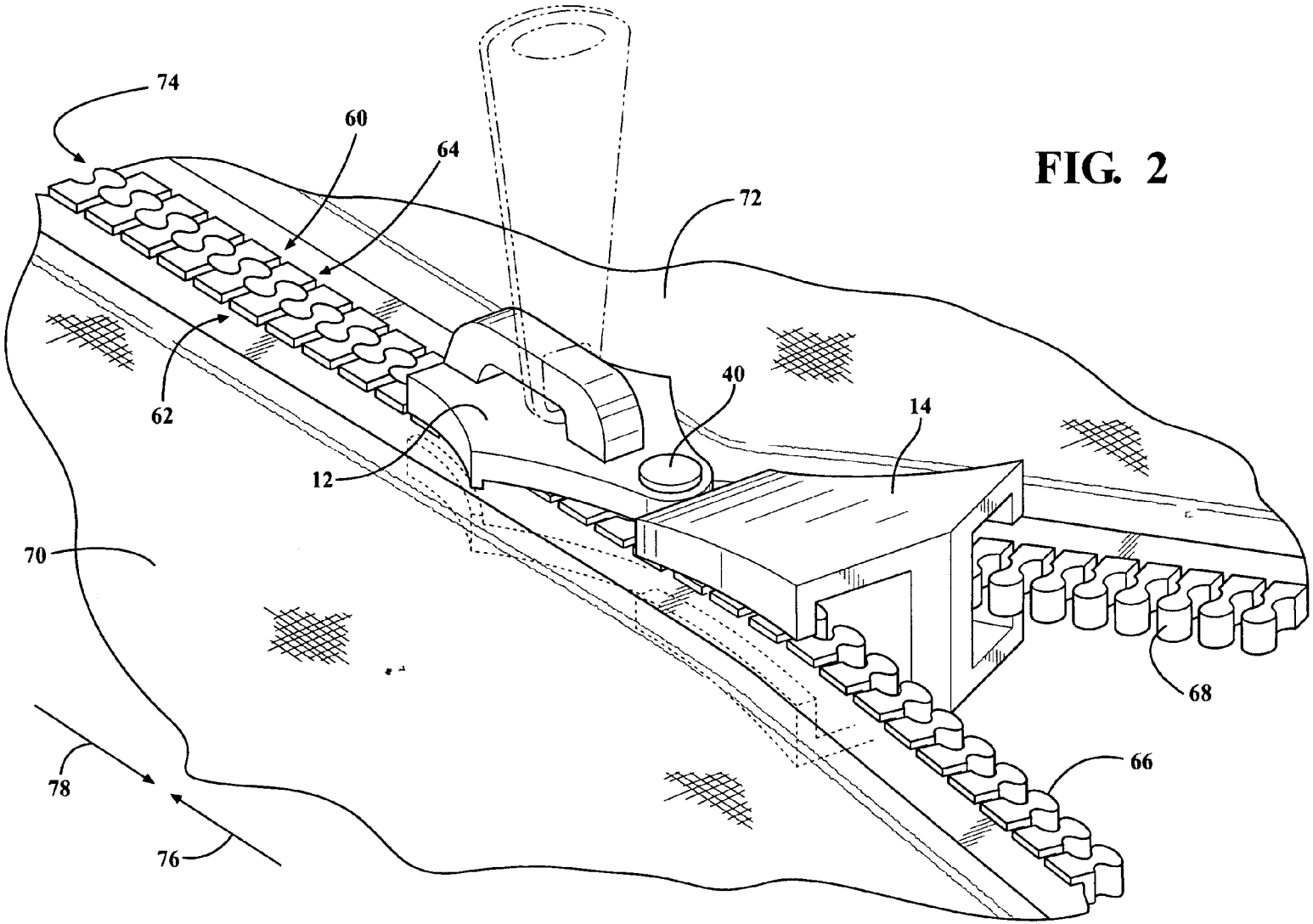
FIG. 2 is a perspective view of a zipper pre-gather device connected to a foldable window and a foldable, stowable roof, according to the present invention.

Referring again now to the Figures generally, and with specific reference to FIG. 2, the zipper having a pre-gather device 10 is shown with a zipper, generally shown at 60, which includes a first side of the zipper tape, generally shown at 62, and a second side of the zipper tape, generally shown at 64. The first side of the zipper tape 62 includes a first set of zipper teeth 66, and the second side of the zipper tape 64 includes a second set of zipper teeth 68. The first set of zipper teeth 66 are connected to a portion of a foldable, stowable roof 70, and the second set of zipper teeth 68 are connected to either a second portion of the foldable, stowable roof 70, or in this embodiment, are connected to a foldable window 72.

In operation, the foldable stowable roof 70 is movable between a stowed position and a deployed position. When in the deployed position, it may be desirable for the user to open the foldable window 72. The handle feature is used to pull the slider 12 and pre-gather device 14 such that the portion of the sides of the zipper tape 62,64 which are assembled, shown generally at 74, move through the back end of the slider 12 in the direction of the first arrow 76, and therefore through the passages 26,28, and then through the pre-gather device 14. When the slider 12 and pre-gather device 14 travel in the direction of the first arrow 76, the sides of the zipper tape 62,64 separate, allowing the user to fold and open the foldable window 72.

When it is desired to close the foldable window 72, the zipper teeth 66,68 may not be sufficiently positioned (due to folds or bends in the foldable window 72 or the foldable, stowable roof 70) to properly pass through the slider 12, making it difficult to move the slider 12 along both sides of the zipper tape 62,64. However, the pre-gather device 14 facilitates the alignment of both sides of the zipper tape 62,64. As the slider 12 and pre-gather device 14 are moved along in the direction of the second arrow 78, the first set of zipper teeth 66 pass through the third passage 42 and the second set of zipper teeth 68 pass through the fourth passage 44. Additionally, both sides of the zipper tape 62,64, and therefore the roof 70 and window 72, pass through the respective gapped portions 46 formed along the sides of each of the passages 42,44. Because the entrance 48 of the third and fourth passages 42,44 have a significantly larger width 52 and height 54 in relation to the width 56 and height 58 of the exit 50, both sides of the zipper tape 62,64 are easily fed through the passages 42,44. Additionally, the inside surface of each of the passages 42,44 is tapered such that there is a gradual decrease in size from the entrances 48 of the passages 42,44 to the exits 50 of the passages 42,44, further facilitating the alignment of both sides of the zipper tape 62,64.

Movement of both sides of the zipper tape 62,64 through the passages 42,44 is also facilitated by the pivot connection between the pre-gather device 14 and the slider 12, which is created by the pivot pin 40. Because of the large size of the entrance 48 of each of the passages 42,44 and the pivot connection between the slider 12 and the pre-gather device 14, both sides of the zipper tape 62,64 may be positioned at a large angle relative to one another, and are still easily moved through the pre-gather device 14.

Once both sides of the zipper tape 62,64 have passed through the pre-gather device 14, the sets of zipper teeth 66,68 are in proper alignment to pass through the slider 12, but are not interlocked with one another. The first set of zipper teeth 66 become interlocked with the second set of zipper teeth 68 as the first set of zipper teeth 66 pass through the first passage 26 and the second set of zipper teeth 68 pass through the second passage 28. The zipper teeth 66,68 are interlocked after passing through the respective passages 26,28, best seen in FIG. 2.

The pre-gather device 14 of the present invention provides for proper alignment of the two sets of zipper teeth 66,68 prior to entering into the slider 12, and is further facilitated by the pivot connection between the pre-gather device 14 and the slider 12. This substantially eliminates the need for manually aligning the first set of zipper teeth 66 and the second set of zipper teeth 68 by positioning the foldable, stowable roof 70 or the foldable window 72.

While it has been shown and described that the first set of zipper teeth 66 are connected to the foldable roof 70 and the second set of teeth are connected to a foldable window 72, it is within the scope of the invention that the zipper having a pre-gather device 10 may be used in any different applications where a zipper connection is used. For example, the device 10 of the present invention may be used with items such as, but not limited to, pants, jackets, shirts, shoes, tonneau covers, tents, tarps, or any other suitable application. Additionally, while the pivot pin 40 extending through the apertures 32,34, 38 is used to provide the pivot connection between the pre-gather device 14 and the slider 12, it is also within the scope of the invention that other connections may be use to allow for a pivot or swivel relationship between the slider 12 and the pre-gather device 14, such as, but not limited to, a ball and socket, ball joint, rivet, bearing, and the like.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A zipper pre-gather device, comprising:

a slider operable for connecting a first side of zipper tape to a second side of zipper tape;

a pre-gather device operable for providing proper alignment of both of said first side of zipper tape and said second side of zipper tape prior to said first side of zipper tape and said second side of zipper tape passing through said slider;

a first passage formed as part of said slider, said first side of zipper tape operable for passing through said first passage; and a second passage formed in said slider separate from said first passage, said second section of zipper tape operable for passing through said second passage;

a first set of zipper teeth connected to said first section of zipper tape;

a second set of zipper teeth connected to said second section of zipper tape;

wherein as said slider is moved in a first direction, said pre-gather device provides proper alignment of said first set of zipper teeth and said second set of zipper teeth, facilitating the movement of said first set of zipper teeth through said first passage and facilitating the movement of said second set of zipper teeth through said second passage such that said first set of zipper teeth become interlocked with said second set of zipper teeth after exiting said first passage and said second passage;

wherein as said slider is moved in a second direction and said first set of zipper teeth are interlocked with said second set of zipper teeth, said slider detaches said first set of zipper teeth from said second set of zipper teeth, allowing said first set of zipper teeth to pass through said first passage and said pre-gather device, and allowing said second set of zipper teeth to pass through said second passage and said pre-gather device;

an upper section, said upper section forming a part of said first passage, and said upper section forming a part of said second passage;

a lower section said lower section forming a part of said first passage, and said lower section forming a part of said second passage;

a first gapped portion formed by said upper section and said lower section, said first gapped portion extending along a side of said first passage said first side of zipper taped operable for passing through said first gapped portion as said first set of zipper teeth move through said first passage;

a second gapped portion formed by said upper section and said lower section, said second gapped portion extending along a side of said second passage, said second side of zipper tape operable for passing through said second gapped portion as said second set of zipper teeth move through said second passage;

a first aperture formed in said upper section of said slider;

a second aperture formed in a flange portion of said pre-gather device;

a third aperture formed in said lower section of slider, said flange portion of said pre-gather device located between said upper section of said slider and said lower section of said slider such that said second aperture is substantially aligned with said first aperture and said third aperture; and pivot pin operable for extending through said first aperture, said second aperture, and said third aperture thereby providing a pivot connection between said slider and said pre-gather device.

2. The zipper pre-gather device of claim 1, said pre-gather device further comprising:

a third passage, said first side of zipper tape operable for passing through said third passage such that said first side of zipper tape is properly aligned prior to passing through said first passage of said slider; and a fourth passage, said fourth passage being separate from said third passage, said second side of zipper tape operable for passing through said fourth passage such that said second side of zipper tape is properly aligned prior to passing through said second passage of said slider.

3. The zipper pre-gather device of claim 2, further comprising:

a third gapped portion formed as part of said pre-gather device, said third gapped portion extending along a side of said third passage, said first side of zipper tape operable for passing through said third gapped portion as said first set of zipper teeth move through said first passage; and a fourth gapped portion formed as part of said pre-gather device, said fourth gapped portion extending along a side of said fourth passage, said second side of zipper tape operable for passing through said fourth gapped portion as said second set of zipper teeth move through said fourth passage.

4. The zipper pre-gather device of claim 2, further comprising:

an entrance formed as part of said third passage; and an exit formed as part of said third passage, said exit formed as part of said third passage being smaller in width and height in relation to said entrance formed as part of said third passage, and as said first side of zipper tape moves though said third passage, said first side of zipper tape becomes properly aligned with said first passage.

5. The zipper pre-gather device of claim 2, further comprising:

an entrance formed as part of said fourth passage; and an exit formed as part of said fourth passage, said exit formed as part of said fourth passage being smaller in width and height in relation to said entrance formed as part of said fourth passage, and as said second side of zipper tape moves through said fourth passage, said second side of zipper tape is properly aligned with said second passage.

6. The zipper pre-gather device operable for using with a foldable, stowable roof of claim 1, further comprising:

a first gapped portion formed by said upper section and said lower section extending along a side of said first passage, said first side of zipper tape operable for passing through said first gapped portion as said first set of zipper teeth move through said first passage;

a second gapped portion formed by said upper section and said lower section extending along a side of said second passage, said second side of zipper tape operable for passing through said second gapped portion as said second set of zipper teeth move through said second passage; and a third gapped portion formed as part of said pre-gather device and extending along said third passage, said first side of zipper tape operable for passing through said third gapped portion as said first set of zipper teeth move through said first passage; and a fourth gapped portion formed as part of said pre-gather device and extending along said fourth passage, said second side of zipper tape operable for passing through said fourth gapped portion as said second set of zipper teeth move through said fourth passage.

7. The zipper pre-gather device operable for using with a foldable, stowable roof of claim 1, further comprising:

a first aperture formed in said upper section of said slider;

a second aperture formed in a flange portion of said pre-gather device;

a third aperture formed in said lower section of slider, said flange portion of said pre-gather device located between said upper section of said slider and said lower section of said slider such that said second aperture substantially aligned with said first aperture and said third aperture; and a pivot pin operable for extending through said first aperture, said second aperture, and said third aperture, thereby providing a pivot connection between said slider and said pre-gather device.

8. The zipper pre-gather device of claim 1, further comprising:

an entrance formed as part of said third passage;

an exit formed as part of said third passage, said exit formed as part of said third passage being smaller in width and height in relation to said entrance formed as part of said third passage, and as said first side of zipper tape moves though said third passage, said first side of zipper tape becomes properly aligned with said first passage;

an entrance formed as part of said fourth passage;

an exit formed as part of said fourth passage, said exit formed as part of said fourth passage being smaller in width and height in relation to said entrance formed as part of said fourth passage, and as said second side of zipper tape moves through said fourth passage, said second side of zipper tape is properly aligned with said second passage.

9. A zipper pre-gather device operable for using with a foldable, stowable roof, comprising:

a slider;

a first passage formed as part of said slider, a first side of zipper tape operable for moving through said first passage, said first side of zipper tape having a first set of zipper teeth;

a second passage formed as part of said slider, a second side of zipper tape operable for moving through said second passage, said second side of zipper tape having a second set of zipper teeth;

a pre-gather device pivotally connected to said slider;

a third passage formed as part of said pre-gather device, said third passage operable for properly positioning said first side of zipper tape prior to said first side of zipper tape entering said first passage when said slider is moved in a first direction; and a fourth passage formed as part of said pre-gather device, said fourth passage operable for properly positioning said second side of zipper tape prior to said second side of zipper tape entering said second passage when said slider is moved in said first direction.

10. The zipper pre-gather device of claim 9, wherein as said slider is moved in said first direction, said first set of zipper teeth become interlocked with said second set of zipper teeth after exiting said first passage and said second passage.

11. The zipper pre-gather device of claim 9, wherein as said slider is moved in a second direction and said first set of zipper teeth are interlocked with said second set of zipper teeth, said slider detaches said first set of zipper teeth from said second set of zipper teeth, allowing said first set of zipper teeth to pass through said first passage and said third passage, and allowing said second set of zipper teeth pass through said second passage and said fourth passage.

12. The zipper pre-gather device of claim 9, said slider further comprising:

an upper section, a portion of said first passage formed by said upper section, and a portion of said second passage formed by said upper section;

a lower section, a portion of said first passage formed by said lower section, and a portion of said second passage formed by said lower section;

a first gapped portion formed by said upper section and said lower section such that said first gapped portion extends along a side of said first passage, and said first side of zipper tape tends out of said first gapped portion as said first set of zipper teeth move through said first passage; and a second gapped portion formed by said upper section and said lower section such that said second gapped portion extends along a side of said second passage, and said second side of zipper tape extends out of said second gapped portion as said second set of zipper teeth move through said second passage.

13. The zipper pre-gather device of claim 12, further comprising:

a first aperture formed in said upper section of said slider;

a second aperture formed in a flange portion of said pre-gather device;

a third aperture formed in said lower section of slider, said flange portion of said pre-gather device located between said upper section of said slider and said lower section of said slider such that said second aperture substantially aligned with said first aperture and said third aperture; and a pivot pin operable for extending through said first aperture, said second aperture, and said third aperture, thereby providing a pivot connection between said slider and said pre-gather device.

14. The zipper pre-gather device of claim 9, further comprising:

a third gapped portion formed as part of said pre-gather device such that said third gapped portion extends along a side of said third passage, and said first side of zipper tape extends out of said third gapped portion as said first set of zipper teeth move through said third passage; and a fourth gapped portion formed as part of said pre-gather device such that said fourth gapped portion extends along a side of said fourth passage, and said second side of zipper tape extends out of said fourth gapped portion as said second set of zipper teeth move through said fourth passage.

15. The zipper pre-gather device of claim 9, further comprising:

an entrance formed as part of said third passage;

an exit formed as part of said third passage, said exit formed as part of said third passage being smaller in width and height in relation to said entrance formed as part of said third passage, and as said first side of zipper tape moves though said third passage, said first side of zipper tape becomes properly aligned with said first passage;

an entrance formed as part of said fourth passage; and an exit formed as part of said fourth passage, said exit formed as part of said fourth passage being smaller in width and height in relation to said entrance formed as part of said fourth passage, and as said second side of zipper tape moves through said fourth passage, said second side of zipper tape is properly aligned with said second passage.

16. A zipper pre-gather device operable for using with a foldable, stowable roof, comprising:

a slider having an upper section and a lower section;

a first passage formed as part of said upper section and said lower section, said first passage operable for receiving a first set of zipper teeth, said first set of zipper teeth connected to a first side of zipper tape;

a second passage formed as part of said upper section and said lower section, said second passage operable for receiving a second set of zipper teeth, said second set of zipper teeth connected to a second side of zipper tape, and said first passage separate from said second passage;

a pre-gather device pivotally connected to said slider;

a third passage formed as part of said pre-gather device, said first set of zipper teeth extend through said first passage and said third passage; and a fourth passage formed as part of said pre-gather device, said second set of zipper teeth extend through said second passage and said fourth passage;

wherein as said slider is moved in a first direction, said first set of zipper teeth pass through said third passage and move through said first passage, and said second set of zipper teeth pass through said fourth passage and move through said second passage such that after said first set of zipper teeth pass through said first passage and said second set of teeth pass through said second passage, said first set of zipper teeth are interlocked with said second set of zipper teeth after exiting said first passage and said second passage;

wherein as said slider is moved in a second direction and said first set of zipper teeth are interlocked with said second set of zipper teeth, said slider detaches said first set of zipper teeth from said second set of zipper teeth and said first set of zipper teeth pass through said first passage and then pass through said second passage, and said second set of zipper teeth pass through said second passage and then pass through said fourth passage.

* * * * *